US006009820A

United States Patent [19]

Kellog et al.

[11] Patent Number: 6,009,820

[45] Date of Patent: Jan. 4, 2000

[54] SEMI-SUBMERSIBLE VESSEL

[76] Inventors: Stanley Groedecke Kellog, 7803 Feather Springs, Houston, Tex. 77095; Scott Campbell McClure, 12122 Old Oaks, Houston, Tex. 77024

[21] Appl. No.: 09/052,540

[22] Filed: Mar. 31, 1998

[51] Int. Cl.[7] ..... B63B 1/00

[52] U.S. Cl. ..... 114/61.1; 114/61.14; 114/61.2

[58] Field of Search ..... 114/44, 50, 51, 114/61.1, 61.14, 61.2

[56] References Cited

U.S. PATENT DOCUMENTS

| | | | |
|---|---|---|---|
| Re. 32,589 | 2/1988 | Goldman et al. | 405/198 |
| 234,794 | 11/1880 | Lundborg . | |
| D. 270,907 | 10/1983 | Younes | D12/316 |
| D. 271,098 | 10/1983 | Younes | D12/316 |
| 795,002 | 11/1905 | Nelson . | |
| 2,375,286 | 5/1945 | Creed . | |
| 2,889,795 | 6/1959 | Parks | 114/0.5 |
| 3,163,147 | 12/1964 | Collipp | 114/0.5 |
| 3,246,476 | 4/1966 | Wolff | 61/46.5 |
| 3,279,407 | 10/1966 | Stenger | 114/66.5 |
| 3,447,502 | 6/1969 | Leopold | 114/61 |
| 3,490,406 | 1/1970 | O'Reily et al. | 114/0.5 |
| 3,556,033 | 1/1971 | Bonnafous | 114/0.5 |
| 3,623,444 | 11/1971 | Lang | 114/61 |
| 3,653,354 | 4/1972 | Pangalila | 114/125 |
| 3,691,977 | 9/1972 | Eubanks et al. | 114/51 |
| 3,949,693 | 4/1976 | Bauer et al. | 114/0.5 |
| 4,174,671 | 11/1979 | Seidl | 114/61 |
| 4,286,896 | 9/1981 | Melitz et al. | 405/185 |
| 4,436,050 | 3/1984 | Lider | 114/265 |
| 4,498,412 | 2/1985 | Lidén | 114/264 |
| 4,652,177 | 3/1987 | Gunther, Jr. et al. | 405/196 |
| 4,657,437 | 4/1987 | Breeden | 405/198 |
| 4,716,847 | 1/1988 | Wilson, Jr. | 114/61 |
| 4,735,526 | 4/1988 | Kawagoe et al. | 405/196 |
| 4,902,169 | 2/1990 | Sutton | 405/204 |
| 4,913,591 | 4/1990 | Steele | 405/196 |
| 5,038,702 | 8/1991 | Bowes | 114/265 |
| 5,139,366 | 8/1992 | Choate et al. | 405/198 |
| 5,140,924 | 8/1992 | Dixon | 114/61.14 |
| 5,188,484 | 2/1993 | White | 405/198 |
| 5,555,838 | 9/1996 | Bergman | 114/265 |
| 5,575,592 | 11/1996 | Pollack | 405/223.1 |

FOREIGN PATENT DOCUMENTS

| | | |
|---|---|---|
| 1279531 | 1/1991 | Canada . |
| 120831 | 1/1972 | United Kingdom . |
| 1481562 | 8/1977 | United Kingdom . |

OTHER PUBLICATIONS

Roy D. Gaul, et al. Design of a Semisubmerged Swath Research & Survey Ship, Proceedings on the Oceans '88 Conference (1988).

Alan C. McClure & Associates, Inc., General Arrangement Forward/AFT and Elevation (Aug. 27, 1998).

R.D. Gaul & A. C. McClure, Development of the Swath Ship Concept for Research Design Ship, Proceedings of Oceans (1984).

Alan C. McClure & Roy D. Gaul, Let Swath Be Swath, Proceedings (Apr. 1987).

R.D. Gaul, et al., Semi–Ship Favored As Crew Transporter, Offshore Europe (Oct. 5, 1981).

Alan C. McClure Assoc., Inc., General Arrangement Outboard Platform (Aug. 1996).

*Primary Examiner*—Stephen Avila

*Attorney, Agent, or Firm*—Fulbright & Jaworski LLP

[57] ABSTRACT

An uncrossed-braced, column stabilized semi-submersible and improved methods of operation of the same are disclosed. The semi-submersible vessel provides necessary strength to resist hydrodynamic forces via a unitized support system. Improved elliptically shaped columns, haunch supports and reinforcing members provide stability and resist transverse forces. A skirt design minimizes the reduced stability at the transition point. Improved deck designs reduce environmental impacts and provide additional support against transverse forces.

24 Claims, 10 Drawing Sheets

SEMI-SUBMERSIBLE VESSEL

BACKGROUND OF INVENTION

This invention relates to a semi-submersible vessel used in connection with offshore operations, services and resource exploration. More particularly, this invention relates to a hybrid of a column stabilized semi-submersible vessel which expands the useful operations and life thereof.

Increased energy demands and decreased energy resources have created a need to explore and produce resources from deeper offshore areas. The demands of deep water exploration and installation present many technical problems for vessel designers. Existing technology used in offshore operations, services and resource exploration fails to adequately address the many challenges associated with deep water.

Placement of equipment in deep waters necessitates new methods of installation, maintenance, repair and removal. For example, rapid transit speed combined with installation and removal capabilities are desired features which are inadequate in existing designs. Service and maintenance needs related to equipment placed in extreme depths, e.g., flow lines, jumpers, tie-ins and service umbilicles, presents significant issues which known technology fails to adequately address. The time frames associated with installation, maintenance, repair and removal services precludes the use of mooring systems in deep water. Thus, efficient station keeping techniques are required.

One type of vessel used in deep waters is known as a semi-submersible vessel. A semi-submersible vessel comprises a deck section which is typically supported by four or more vertical columns which rest on two or more pontoons. The pontoons and portions of the columns are submerged below the operational water line during normal operation. In order to provide adequate structural integrity, cross brace support members are typically used between the columns. Cross brace support members, while essential to the structural integrity of traditional designs for semi-submersible vessels, create undesirable characteristics. For example, cross brace support members create hydrodynamic drag and create problems related to underslung loads.

U.S. Pat. No. 4,436,050 illustrates a hybrid of a traditional cross braced semi-submersible vessel. In the disclosed vessel, a pair of support members run generally parallel between the pontoons. Such an alternative design fails to fully address performance and operational issues.

Canadian Patent No. 1,279,531 discloses a semi-submersible vessel without any cross bracing, but fails to disclose means which would adequately support such a structure.

Thus, a need remains for an improved semi-submersible vessel design with expanded capabilities, and alternative structural supports which do not unnecessarily interfere with advantageous operations of such vessels.

SUMMARY OF INVENTION

It is therefore an object of the present invention to provide an improved semi-submersible vessel which does not require cross-bracing.

Another object of the present invention is to provide a haunch support means which eliminates the need for cross brace support members in a semi-submersible vessel.

A further object of the present invention is to provide an improved column design which can be incorporated into a semi-submersible vessel.

Yet another object of the present invention is to provide a semi-submersible vessel with improved hydrodynamic properties.

Another object of the present invention is to provide a semi-submersible vessel with improved stability at the transition point.

An additional object of the present invention is to provide a semi-submersible vessel with an improved unitized structural design.

Yet another object of the present invention is to provide an improved method for loading underslung loads onto a semi-submersible vessel.

Thus to achieve these objects, there is provided in one embodiment of the present invention an improved design for a semi-submersible vessel which includes a deck supported by columns and a haunch means. More particularly, in one embodiment of the present invention, there is provided a vessel comprising two pairs of columns, the first pair being connected to a first pontoon and the second pair being connected to a second pontoon and haunch means which connects the first and second pair of columns to a deck.

In a preferred embodiment, the haunch means comprises a diagonal structure which flares inboard and connects the column to an upper box structure. More particularly, there is provided elliptically shaped columns which more evenly distribute forces. Further preferred, the columns comprise internal bulkheads, which preferably expand in way of the haunch and connect to the upper box structure. In a most preferred embodiment, the columns are elliptically shaped, and include two or more internal bulkheads.

In another aspect of the present invention, there is provided improved elliptical columns for use in a semi-submersible vessel. In a preferred embodiment, the columns include a flared skirt. Most preferred, the skirt flares at an angle from about thirty to about sixty degrees.

In another aspect of the present invention there is provided an improved structural design which further incorporates multiple decks as support members in a unitized structure. More particularly, there is provided a double bottom structure, which includes a first deck, a second deck and a wet deck. Preferably, the wet deck and the second deck are connected are connected by a plurality of support members. Further preferred, the wet deck and the second deck are connected to the columns by a haunch means. The integration of structural components creates a continuous unitized structure.

In another aspect of the present invention, there is provided an improved method for loading or carrying an underslung load. More particularly, there is provided an improved method which includes the steps of placing a barge or similar load carrying vessel under a semi-submersible vessel, lowering a line or lines from said semi-submersible vessel, connecting the lowered line or lines to a load and raising the load.

Other objects, features and advantages of the present invention will become apparent from a review of the detailed description of the preferred embodiments, including the illustrative drawings and the appended claims which follow.

DETAILED DESCRIPTION OF THE PRESENT INVENTION

The present invention provides a mobile vessel designed to accomplish a variety of functions at an offshore site. In contrast to known vessel designs and improvements, the present invention provides a stable semi-submersible vessel design with expanded capabilities, without support members which impair hydrodynamic properties and the useful operation of such a vessel.

As discussed above, depleted energy resources and increased energy demand has created a need for a deep water resource exploration and service vessel. The usefulness of existing semi-submersible vessel designs is somewhat limited because prior designs have unnecessarily limited transit speeds and the normal operations of such vessels.

The primary structural forces on a semi-submersible vessel are in the transverse direction. As used herein, transverse forces are those forces with a direction generally perpendicular to the pontoons of a semi-submersible vessel. In traditional semi-submersible vessels, a truss system is used to counteract transverse forces and provide structural integrity.

Figure 1:
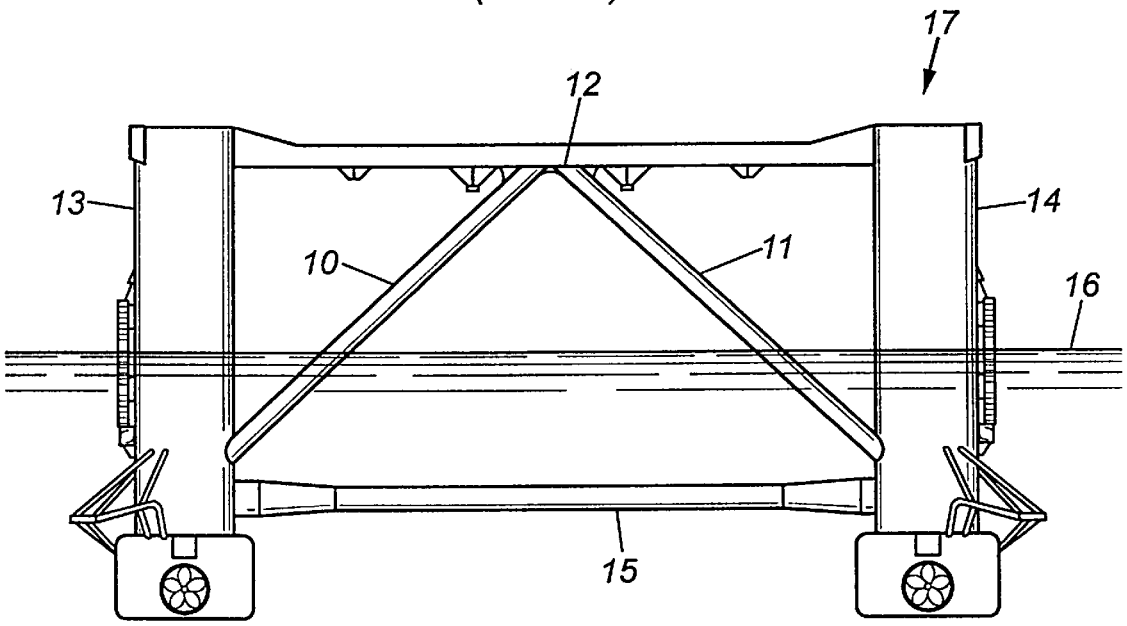
FIG. 1 (Prior Art)
FIG. 1 is an end view of a prior cut cross braced semi-submersible vessel.
Figure 2:
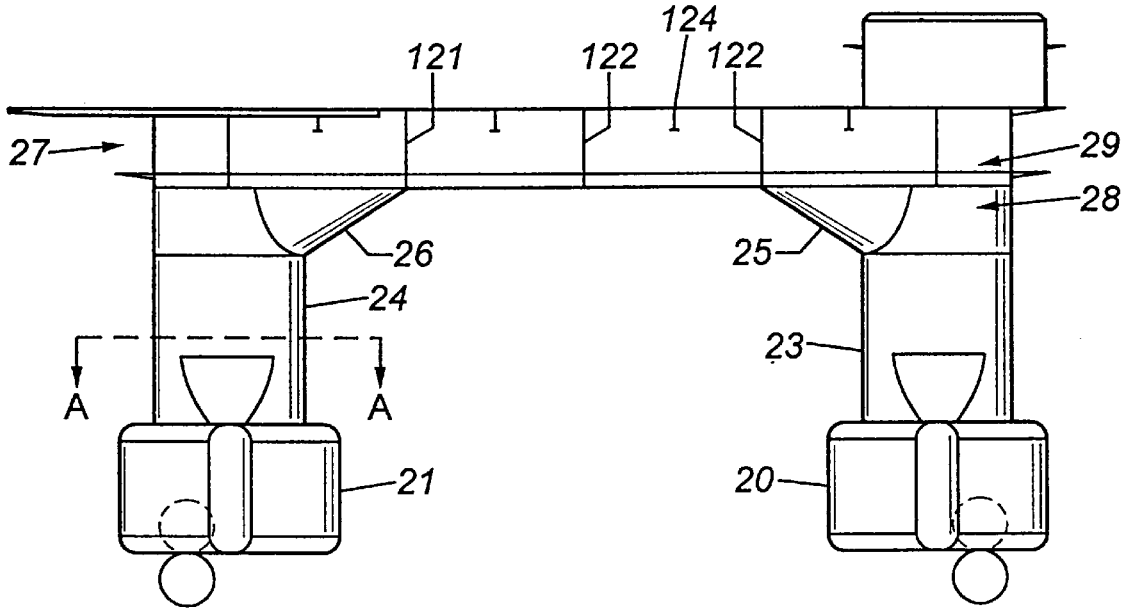
FIG. 2 is an elevation view of the bow of a vessel which illustrates the current invention.
Figure 3:
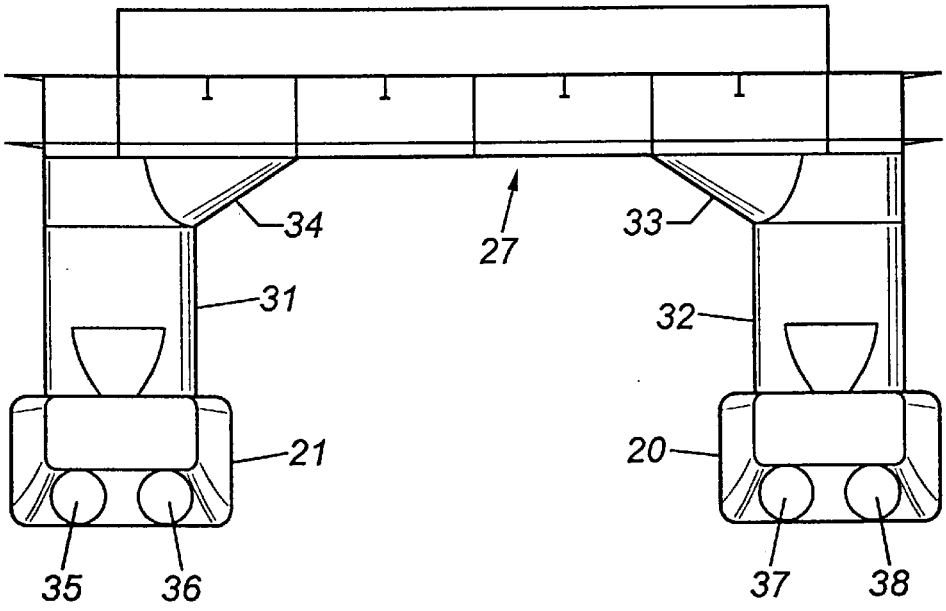
FIG. 3 is an elevation view of the stern of the vessel of FIG. 2.
Figure 4A:
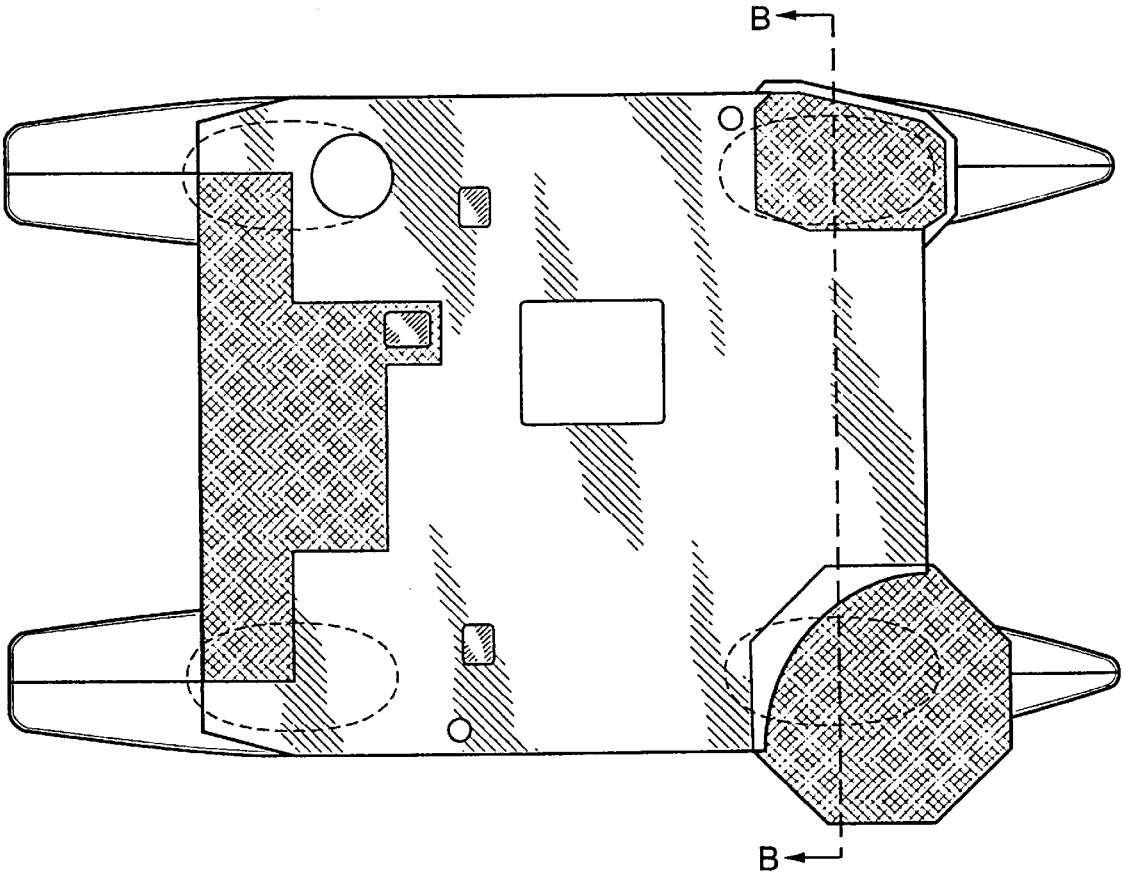
FIG. 4*a* is a top view of the first deck of the vessel of FIG. 2.
Figure 4B:
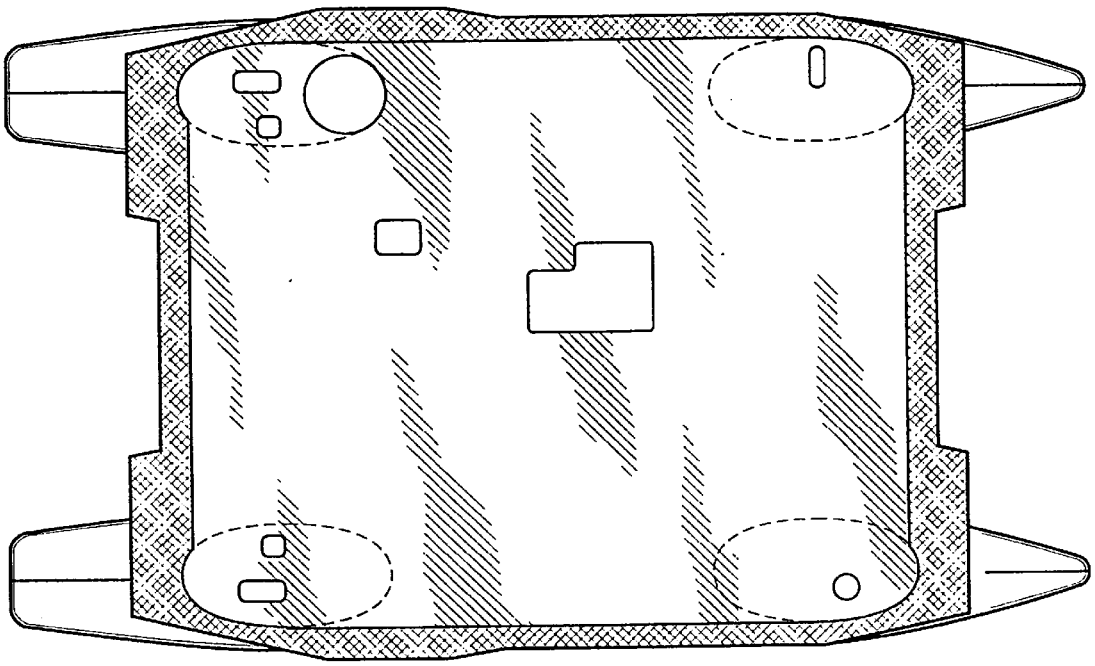
FIG. 4*b* is a top view of the second deck of the vessel of FIG. 2.
Figure 5A:
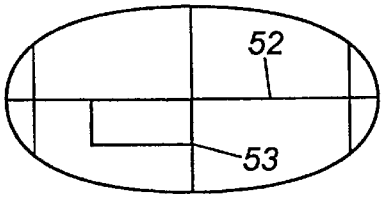
FIG. 5*a* is an ellipse.
Figure 5B:
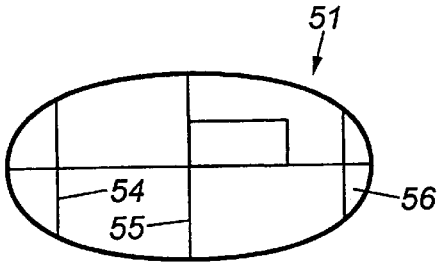
FIG. 5*b* is a cross sectional view of the columns of the vessel of FIG. 2 along line A.
Figure 6:
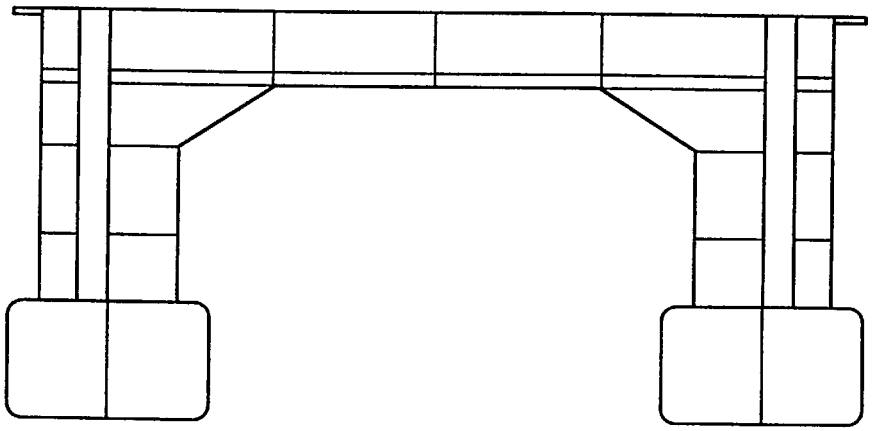
FIG. 6 is a cross sectional view of the vessel of FIG. 2 along Line B of FIG. 4*a*.
Figure 7:
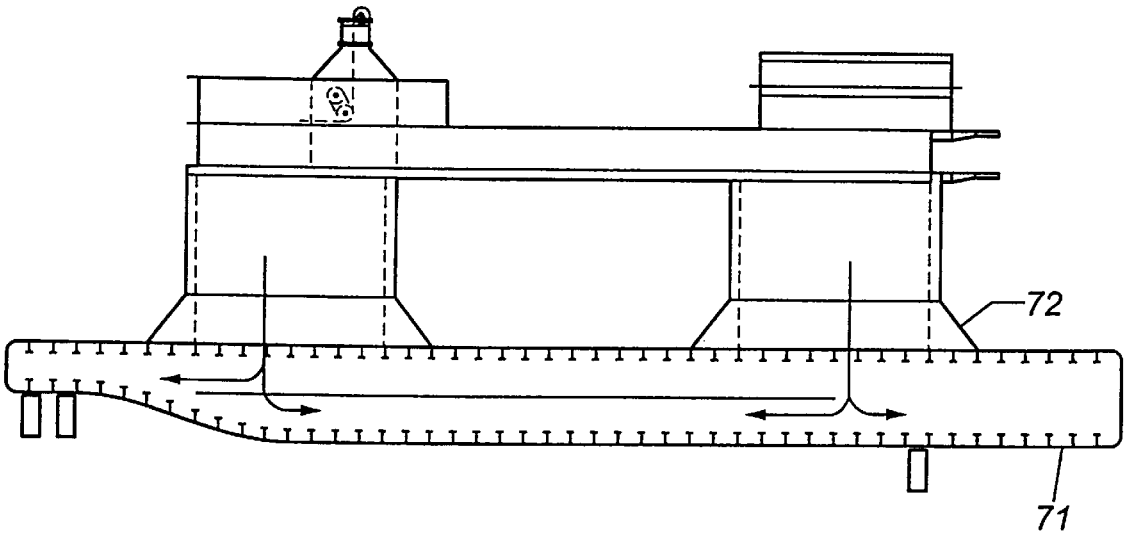
FIG. 7 is a side elevational view of the vessel of FIG. 2.

Referring first to FIG. 1 of the drawings, designs of semi-submersible vessels known in the art may be better understood. A typical truss design is shown. The truss comprises a first and a second diagonal support member 10 and 11 which run from the deck 12 to the first and second columns 13 and 14. An additional horizontal support member 15 is completely below the operational water line 16, and a significant portion of the first and second diagonal support members are also below the operational water line 16.

Semi-submersible vessels are by their nature mobile but also face the challenge of maintaining constant position. Incorporating additional cross brace structures under the operational water line 16 creates undesirable hydrodynamic drag. Current and waves impacting diagonal support member 10 and 11 and horizontal support member 15 adversely affect station keeping performance. In a similar manner, such members adversely limit transit speed of such a vessel. Further, the incorporation of diagonal support member 10 and 11 and horizontal support member 15 impairs the vessels ability to load and carry underslung loads.

In a vessel such as the semi-submersible shown in FIG. 1, a large load may be handled by a method known to those skilled in the art as keel hauling. The keel hauling method requires the steps of lowering a line (not shown) below the operational water line 16, taking the line under the horizontal support member 15, raising the line above the operational water line 16, connecting the line to a load (not shown) on a barge or other vessel (not shown). The load must then be lowered into the water independent of the semi-submersible, for example, by a derrick barge. When the load is lowered, the load is allowed to swing under the semi-submersible in a pendulum like manner, thereby transferring the load to the semi-submersible. Obviously, keel hauling creates certain operational risks.

Referring now to FIGS. 2–9 of the drawings, the invention may be better understood.

In a service vessel used at multiple offshore sites, the combined functional requirements create new design considerations which known vessels have failed to adequately address. The current invention discloses novel designs which accomplish the desired functionality. A unitized structural system is disclosed which allows greater overall operational flexibility of the vessel, while reducing hydrodynamic drag. Furthermore, the unitized structural support of the current invention distributes forces over a greater overall area so as to minimize peak stresses and thereby maximize the fatigue life of the vessel.

Referring now to the drawings, the invention is embodied in an uncross-braced, column stabilized service vessel with the general features illustrated in FIGS. 2 through 11. The vessel includes two generally parallel pontoons 20 and 21 which are connected to preferably elliptically shaped column supports 23, 24, 31 and 32, which in turn support horizontal box 27, which is composed of structures between wet deck 28 and first deck 124. Preferably, haunch means 25, 26, 33 and 34 transfer forces into horizontal box 27.

The elliptically shaped column supports comprise an outer shell 51 which is a primary strength member. The elliptically shaped column supports 23, 24, 31 and 32 comprise a major axis 52 which is generally parallel to pontoons 20 and 21, a minor axis 53 which is generally perpendicular to pontoons 20 and 21. By elongating columns 23, 24, 31 and 32 along pontoons 20 and 21, enhanced ability to resist transverse forces is achieved. Preferably the major axis 52 is from about one and a half to three times greater than the minor axis 53. Further preferred, the major axis is about one and three-quarters to two and one-quarter greater than the minor axis 53.

Semi-submersibles have in the past incorporated rectangular and rounded columns to support the upper deck over the pontoons. A rectangular column provides a good structural connection between the deck and the pontoons, but creates a high drag by virtue of its shape. Rounded columns create less drag than rectangular columns and such drag is independent of direction, but offer limited structural support between the pontoons and the upper deck. The unitized structure of the present invention incorporates elliptical columns which provide improved support against transverse forces. Stated otherwise, an elliptically shaped column offers greater structural support than a round column, without adding the hydrodynamic drag of a rectangular column. By way of example, assuming the minor axis 53 (FIG. 5*a*) of an elliptically shaped column is equal to the diameter of a circular column, an elliptically shaped column provides increased structural capacity as compared to the circular column. Such increase is equal to the ratio of the major axis of the elliptically shaped column divided by the diameter of the circle.

An elliptical shape has additional structural benefits. By using an elliptical shape, forces may be distributed over a greater area. By distributing the forces over a greater area, the useable life of the vessel is increased because fewer high stress points are incorporated into the vessel.

The elongated elliptical shape provides additional benefits. By elongating column supports 23, 24, 31 and 32, additional support against transverse forces may be incorporated internally to the column supports 23, 24, 31 and 32. The shape of a circular column inhibits the incorporation of multiple transverse bulkheads. Thus, in another aspect of the present invention there is disclosed enhanced bulkhead support members. Two or more generally parallel, transverse bulkheads may be incorporated in an elliptical structure. Three generally parallel bulkheads 54, 55, and 56 are preferably incorporated into each of the column supports 23, 24, 31, and 32. The parallel bulkheads 54, 55 and 56 are preferably connected to, respectively, pontoon 20 or 21 and the horizontal box 27. The parallel bulk heads 54, 55 and 56 may be connected in manners well known to those skilled in the art of ship building, for example, by welding.

Figure 8A:
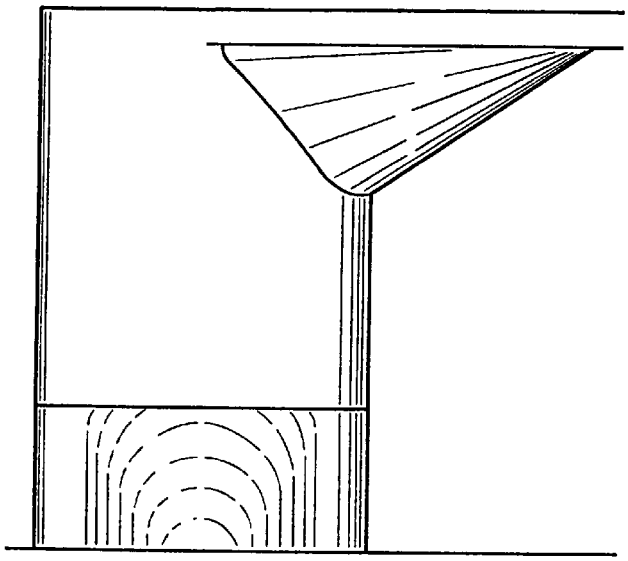
FIG. 8*a* is a longitudinal at elevation view of the column of the vessel of FIG. 2.
Figure 8B:
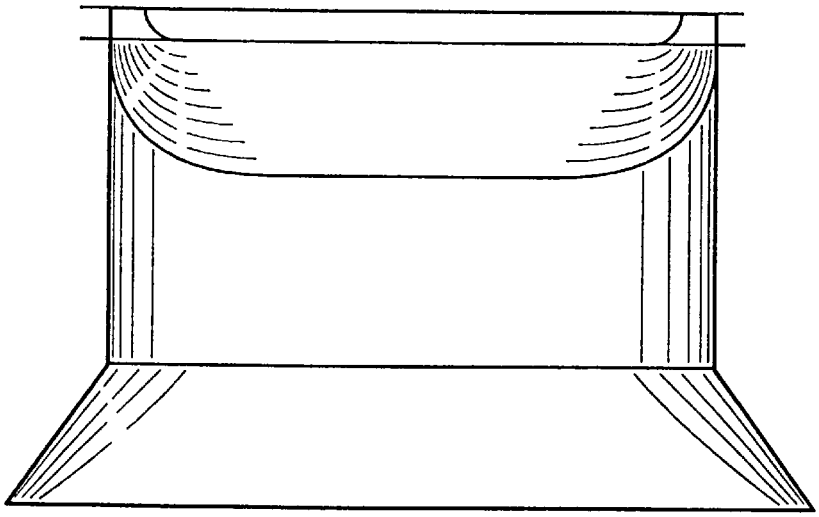
FIG. 8*b* is a transverse view of the column of the vessel in FIG. 2.
Figure 9:
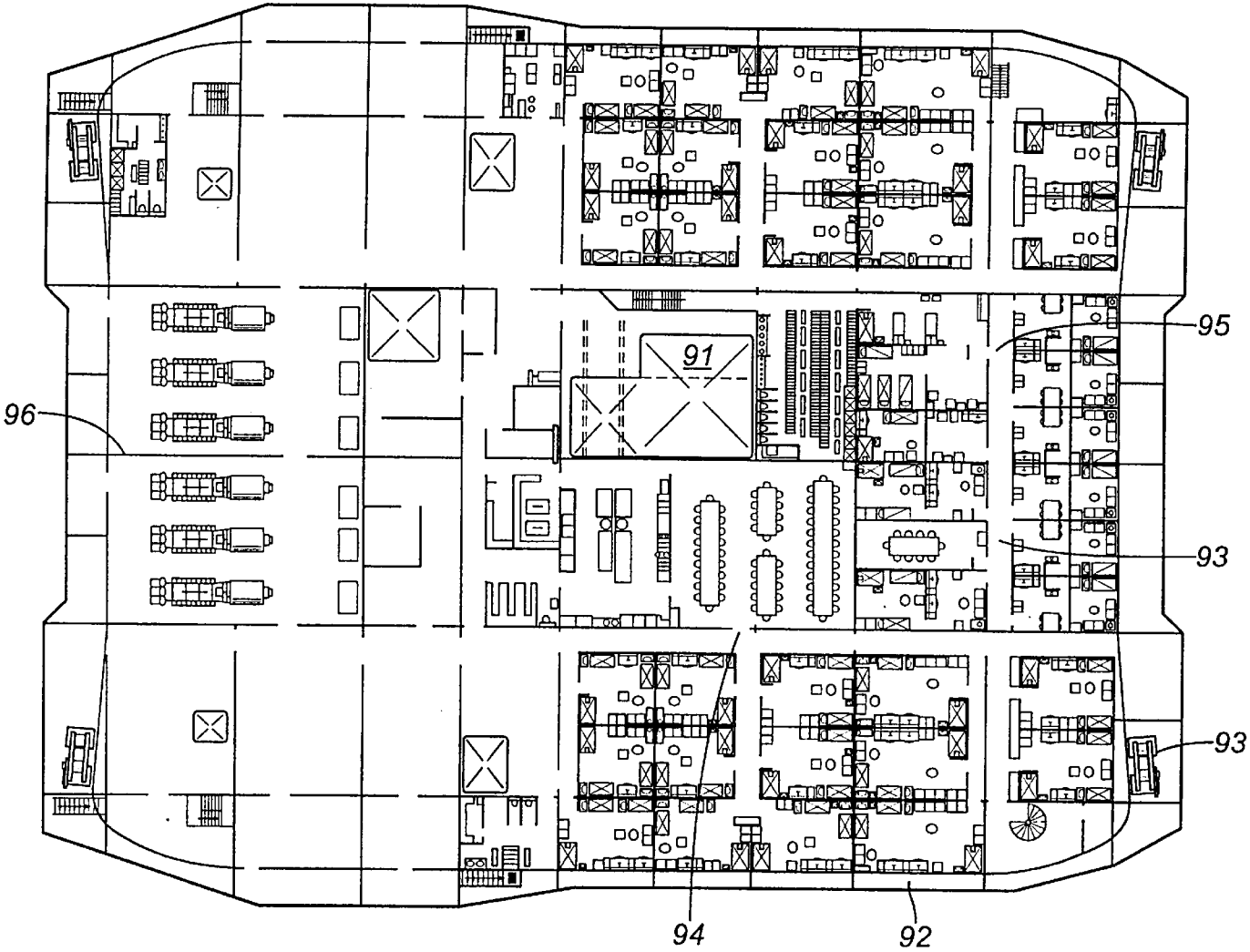
FIG. 9 is a view of a preferred habitat incorporated into the vessel of FIG. 2.

Preferably, the column supports 23, 24, 31 and 32 are connected to the horizontal box 27 with a haunch means 25, 26, 33 and 34, which transfers forces. In such a preferred embodiment, the skin 51 of the column supports 23, 24, 31 and 32 flares in an inboard direction to create haunch means 25, 26, 34 and 33 (FIG. 8). Preferably, the included angle defined by the haunch means 25, 26, 33 and 34 and the horizontal box 27 is from about twenty to about sixty degrees. Most preferred, such angle is from about thirty to about forty five degrees.

Figure 10A:
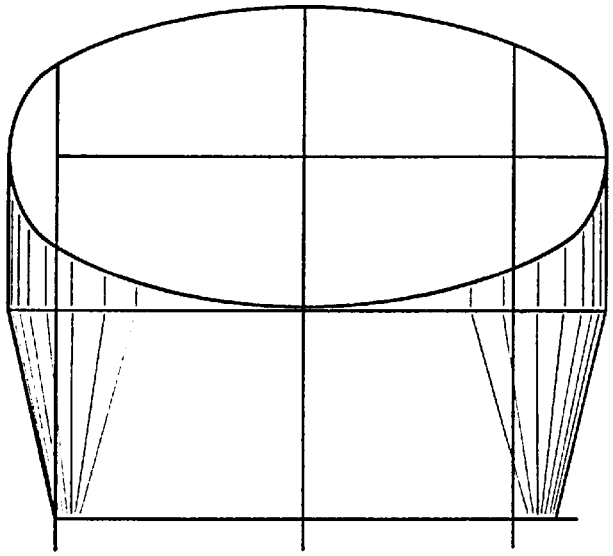
FIG. 10*a* is a plan view of the columns of the vessel of FIG. 2 at the wet deck.
Figure 10B:
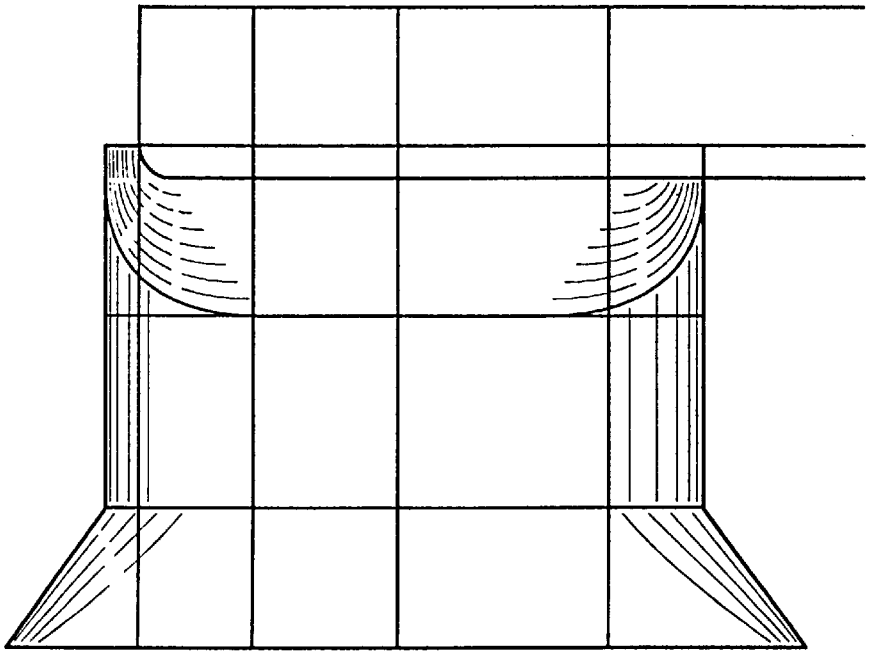
FIG. 10*b* is an elevation view of the columns of the vessel of FIG. 2.
Figure 10C:
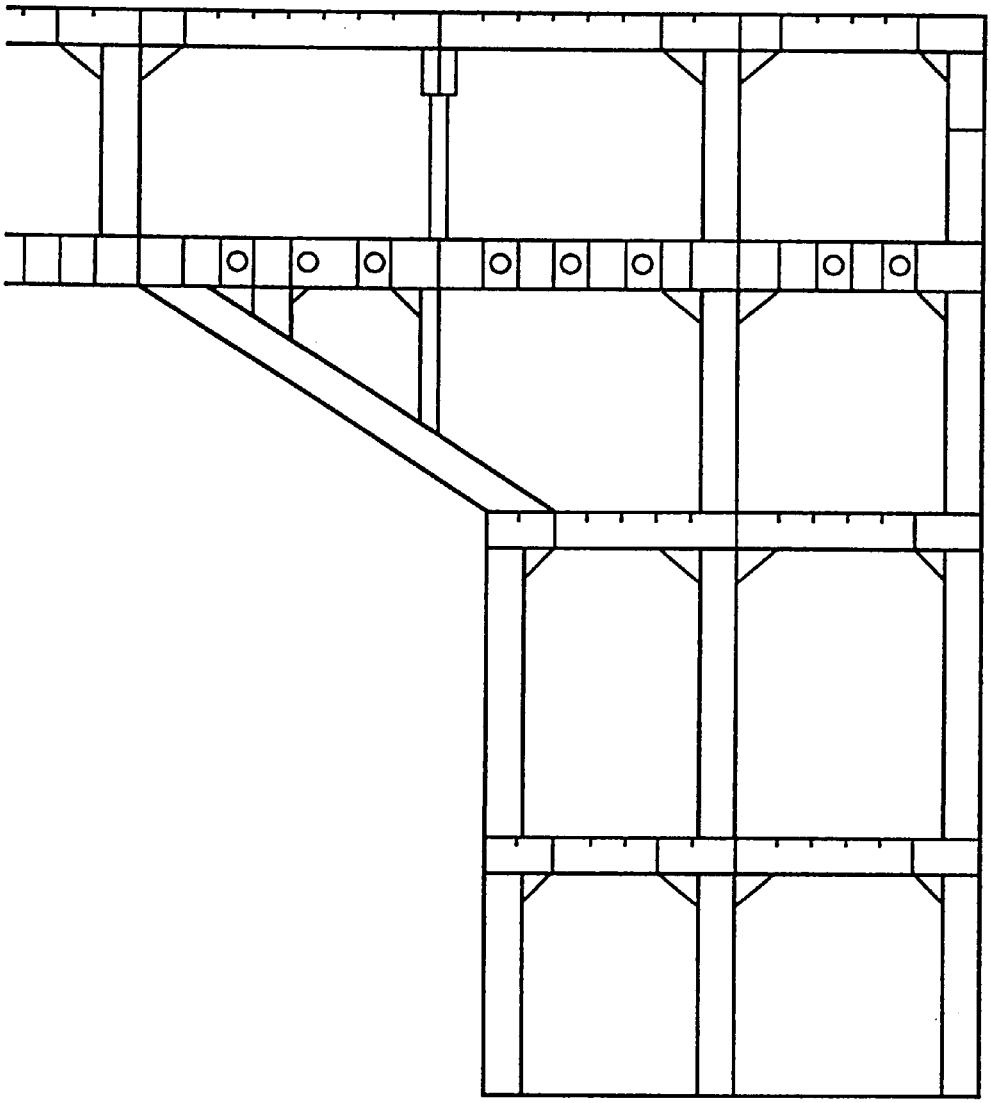
FIG. 10*c* is a sectional view of the columns of vessel of FIG. 2.
Figure 11:
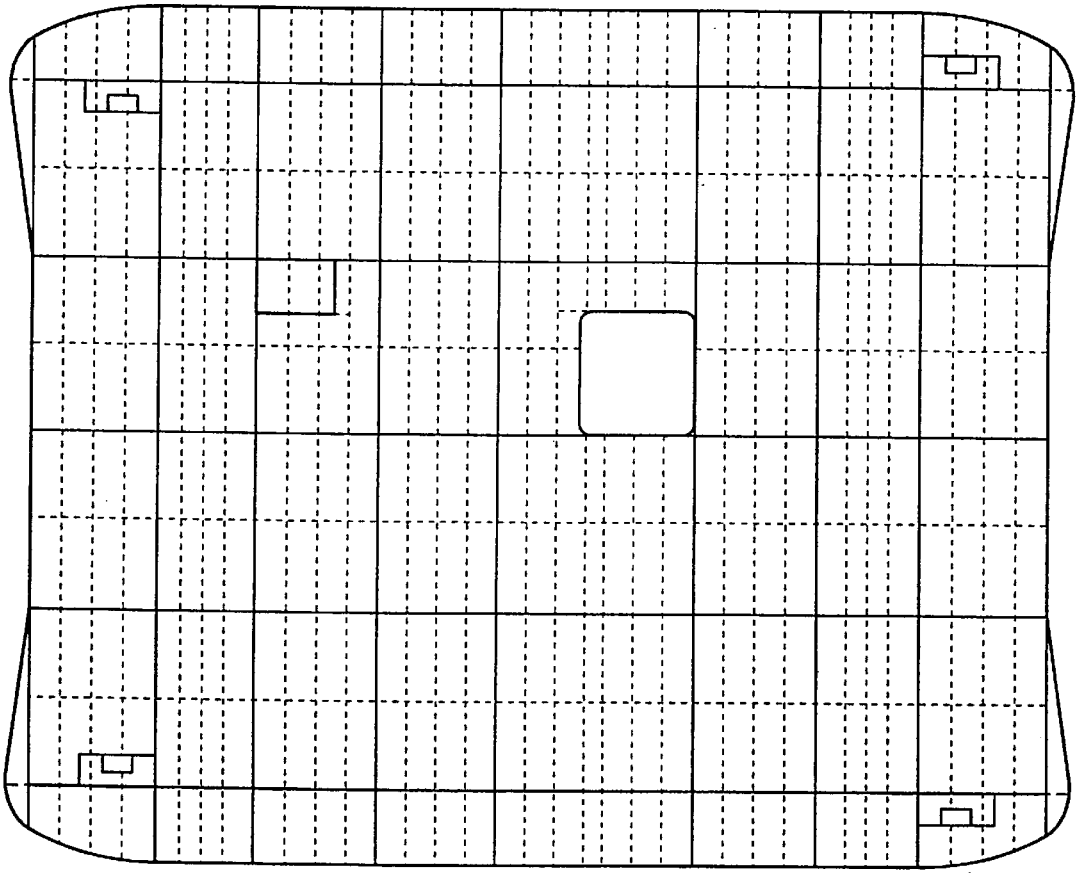
FIG. 11 is a view of the second deck of the vessel of FIG. 2.

Preferably, the vertical bulkheads 54, 55 and 56 flare and expand in way of, haunch means 25, 26, 33 or 34. By flaring the vertical bulkheads 54, 55 and 56, additional support is provided to resist transverse forces. Additional support members 81 may also be provided internally to support columns 23, 24, 31 and 32 as shown in FIG. 10*c*. Further, horizontal support members 82 are preferably included within the support columns 23, 24, 31 and 32 to maintain the structural integrity of support columns 23, 24, 31 and 32.

Thus, the combination of elliptical columns, internal bulkheads and haunch supports provides a stable structure capable of resisting transverse forces. Beneficially, the transverse forces are adequately resisted without diagonal and horizontal support members. Accordingly, the present invention is well suited for multiple services, including transit exploration, intervention, repair, installation and removal.

In another aspect of the present invention, there is provided an improved structural design which provides additional support to the horizontal box 27 described above. Traditional designs utilize a deck structure with exposed stiffeners. The stiffeners are required to prevent buckling of the deck. The stiffeners are exposed to corrosion.

The current invention discloses a double bottom structure capable of withstanding greater loads than traditional designs, while protecting the stiffeners 121 (FIG. 11) from corrosion. In a preferred embodiment, the improved deck design includes a wet deck 28, a second deck 29 and a first deck 124. Collectively the wet deck 28, second deck 29 and first deck 124 define improved horizontal box 27. Preferably, stiffener 121 connects second deck 29 and wet deck 28. In addition to providing increased resistance to the transverse forces, wet deck 28 provides an environmental barrier which limits the exposure of stiffener 121 to environmental conditions, and, thus, susceptibility to corrosion. Further, the double bottom space defined by wet deck 28 and second deck 29 creates space for storage, including fluid storage. Moreover, the double bottom space provides enhanced damage stability protection.

In another aspect of the present invention, there is provided an improvement which addresses the stability concerns related to the transition point. When submerging a semi-submersible vessel via ballasting, the point at which the pontoons of a semi-submersible vessel are first completely submerged is known as the transition point. At the transition point, the stability of the vessel is dramatically reduced. It is desirable to minimize the effects of the transition point and improve the stability of semi-submersible vessels.

The current invention discloses a flared skirt 72 (FIG. 7) along the major axis 52 of the support columns 23, 24, 31 and 32. Flared skirt 72 increases the water plane area at the transition point, and thereby minimizes the decreased stability which otherwise occurs at the transition point. Stated otherwise, flared skirt 72 acts as a buffer and provides a more stable transition of a semi-submersible to the normal operating draft.

Preferably, the angle defined by the flared skirt 72 and pontoon member 20 or 21 is at an angle from about thirty to sixty degrees. Most preferred, such angle is from about thirty-five to forty-five degrees.

In addition to providing increased stability at the transition point, the flared skirt 72 streamlines the respective intersection of support columns 23, 24, 31 and 32 and pontoons 20 and 21, thereby further reduces hydrodynamic drag. The flared skirt 72 may also be flared along the minor axis 53 of support columns 23, 24, 31 and 32. However, the more preferred embodiment does not include a flared skirt along the minor axis 53 because the added stability at the transition point does not merit the increased hydrodynamic drag created by a flared skirt along minor axis 53.

The invention may be further defined by the dimensions of the semi-submersible vessel which embodies a most preferred design. In a most preferred embodiment, the pontoons 20 and 21 are approximately ninety five meters long, eight meters tall and thirteen meters wide. The support columns 23, 24, 31 and 32 are approximately fourteen meters tall, with a minor axis 53 of nine meters and a major axis 52 of eighteen meters. Preferably, the support columns 23 and 24 and 31 and 32 are transversely spaced forty three meters apart and support columns 24 and 31 and 23 and 32 are longitudinally spaced forty six meters apart. Preferably, the haunches 25, 26, 31 and 33 commence on the support columns 23, 24, 31 and 32 about ten meters above the pontoons 20 and 21 and connect to the horizontal deck 27 at angle. Support columns 23 and 24 are preferably placed sixteen meters behind the bow 71 of, respectively, pontoon 20 or 21. Similarly configured vessels may be optimally defined by ratios similar to those of the components described above and set forth in the figures.

Preferably, the horizontal box 27 is sixty two meters long and fifty seven meters wide. Preferably, the inboard portion of pontoon 20 is approximately 32 meters away from the inboard portion of pontoon 21. Such a configuration allows for the incorporation of preferred living quarters, facilities and equipment shown in FIG. 9. Again, similarly configured vessels may be optimally defined by ratios similar to those of the components described above and set forth in the figures. Further, such a configuration is capable of supporting four thousand tons of variable deck load, abundant thruster power and large fuel, ballast and well product tanks.

The most preferred embodiment also includes a helicopter landing pad (not shown) moon pool 91, living quarters 92, traction winches 94 and medical facilities 95. Preferably, noise generating equipment 96 is located at the stern end of the vessel and living quarter 92 are located at the bow end of the vessel to provide more comfortable accommodations for crew members.

In another aspect of the present invention, there is provided an improved method for underslinging loads from a semi-submersible vessel. Because the vessel which embodies the current invention does not include horizontal or diagonal cross bracing, a barge (not shown) or other vessel may be placed directly under the moon pool 91 of the semi-submersible vessel. Cranes, winches, derricks and similar devices may drop a line (not shown) directly to the load. Because such a method does not require a separate lift vessel or use of keel hauling, greater loads can be more effectively handled. Examples of such handling include, raising a load, such as a well template, which can then be transported in an underslung position to an offshore site and then installed by the current invention.

The present invention, therefore, is well adapted to carrying out the objectives and obtain the ends and advantages mentioned, as well as others inherent herein. All presently preferred embodiments of the invention have been given for the purposes of disclosure. Numerous changes in the detail of construction may be made which will readily suggest themselves to those skilled in the art and which are encompassed within the spirit of the invention and the scope of appended claims.

What is claimed is:

1. A vessel comprising:

A first, second, third and fourth column, wherein each of said columns comprise a first end and a second end, wherein said first, second, third and fourth columns comprise a major axis and a minor axis, such that said first, second, third and fourth columns are elliptically shaped;

A first, and second pontoon, wherein said first pontoon is connected to said first end of said first and said second columns and said second pontoon is connected to said first end of said third and said fourth columns; and A horizontal box connected with a haunch means to said second end of said first, second, third and fourth columns.

2. The vessel of claim 1, wherein said first, second, third and fourth column comprises a skin, wherein said skin flares inboard to provide structural support.

3. The vessel of claim 2, wherein said skin flares towards said deck platform at an included angle from about thirty to about forty-five degrees.

4. The vessel of claim 1, where said major axis is from about one and one-half to three times greater than said minor axis.

5. The vessel of claim 1, wherein said first end of said first, second, third and fourth columns comprise a skirt, wherein said skirt flares generally wider along said first end of said first, second, third and fourth columns.

6. The vessel of claim 5, wherein said skirt flares at an angle from about thirty to about sixty degrees.

7. The vessel of claim 6, wherein said first, second, third and fourth columns are elliptically shaped and comprise a major axis, and said skirt flares along said major axis of said first, second, third and fourth columns.

8. The vessel of claim 1, wherein each of said first, second, third and fourth columns comprise two or more generally parallel support members connected to said first and said second end of said first, second, third and fourth columns.

9. The vessel of claim 8, wherein said generally parallel support members flare in way of said haunch means.

10. A vessel comprising:

A first, second, third and fourth column, wherein each of said columns comprise a first end and a second end;

A first, and second pontoon, wherein said first pontoon is connected to said first end of said first and said second columns and said second pontoon is connected to said first end of said third and said fourth columns; and A horizontal box connected with a haunch means to said second end of said first, second, third and fourth columns, wherein said horizontal box comprises a first deck, a second deck and a wet deck, wherein said second deck and said wet deck are connected by a plurality of support members.

11. The vessel of claim 10, wherein said first, second, third and fourth column comprises a skin, wherein said skin flares inboard to provide structural support.

12. The vessel of claim 11, wherein said skin flares towards said deck platform at an included angle from about thirty to about forty-five degrees.

13. The vessel of claim 10, wherein said first, second, third and fourth columns comprise a major axis and a minor axis, such that said first, second, third and fourth columns are elliptically shaped.

14. The vessel of claim 13, where said major axis is from about one and one-half to three times greater than said minor axis.

15. The vessel of claim 10, wherein each of said first, second, third and fourth columns comprise two or more generally parallel support members connected to said first and said second end of said first, second, third and fourth columns.

16. The vessel of claim 15, wherein said generally parallel support members flare in way of said haunch means.

17. A semi-submersible vessel comprising:

A first, second, third and fourth elliptical column, wherein each of said elliptical columns comprise a first end and a second end;

A first and second pontoon, wherein said first pontoon is connected to said first end of said first and said second elliptical columns and said second pontoon is connected to said first end of said third and said fourth elliptical columns; and A deck platform connected to said second end of said first, second, third and fourth elliptical columns.

18. The semi-submersible vessel of claim 17, wherein said elliptical columns comprise a major axis, wherever said major axis is generally parallel to said first and said second pontoon.

19. The semi-submersible vessel of claim 17, wherein each of said first, second, third and fourth elliptical columns comprise two or more generally parallel support members connected to said first and said second end of said first, second, third and fourth elliptical columns.

20. The semi-submersible vessel of claim 19, wherein said elliptically shaped columns are connected to said deck platform by a haunch means.

21. The semi-submersible vessel of claim 20, wherein said generally parallel support members flare in way of said haunch means.

22. The semi-submersible vessel of claim 17, wherein said first end of said first, second, third and fourth columns comprise a skirt, wherein said skirt flares generally wider along said first end of said first, second, third and fourth columns.

23. A service vessel comprising:

A first, second, third and fourth column, wherein each of said columns comprise a first end and a second end;

A first and second pontoon, wherein said first pontoon is connected to said first end of said first and said second columns and said second pontoon is connected to said first end of said third and said fourth elliptical columns; and A first deck platform a second deck platform and a surface deck platform, wherein said surface deck platform and said second deck platforms are connected by support members and said second end of said first, second, third and fourth columns are connected to said first deck platform by a haunch means.

24. The service vessel of claim 23, wherein said first, second, third and fourth columns are elliptically shaped.

* * * * *